US007955445B2

(12) United States Patent
Honjo et al.

(10) Patent No.: US 7,955,445 B2
(45) Date of Patent: Jun. 7, 2011

(54) INTERNAL HIGH HARDNESS TYPE PEARLITIC RAIL WITH EXCELLENT WEAR RESISTANCE AND ROLLING CONTACT FATIGUE RESISTANCE AND METHOD FOR PRODUCING SAME

(75) Inventors: Minoru Honjo, Tokyo (JP); Tatsumi Kimura, Tokyo (JP); Shinichi Suzuki, Tokyo (JP); Kimihiro Nishimura, Tokyo (JP); Shinji Mitao, Tokyo (JP); Nobuo Shikanai, Tokyo (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 12/593,463

(22) PCT Filed: Mar. 25, 2008

(86) PCT No.: PCT/JP2008/056277

§ 371 (c)(1),
(2), (4) Date: Sep. 28, 2009

(87) PCT Pub. No.: WO2008/123483

PCT Pub. Date: Oct. 16, 2008

(65) Prior Publication Data

US 2010/0116381 A1 May 13, 2010

(30) Foreign Application Priority Data

Mar. 28, 2007 (JP) ..... 2007-084400
Oct. 10, 2007 (JP) ..... 2007-264824

(51) Int. Cl.
*C21D 8/00* (2006.01)
*C21D 9/04* (2006.01)
*C22C 38/18* (2006.01)
*C22C 38/24* (2006.01)
*C22C 38/40* (2006.01)

(52) U.S. Cl. ..... 148/333; 148/581; 148/584; 148/334; 148/335

(58) Field of Classification Search ..... 148/581, 148/584, 333–335, 320
See application file for complete search history.

(56) References Cited

U.S. PATENT DOCUMENTS 3,846,183 A 11/1974 Henry
(Continued)

FOREIGN PATENT DOCUMENTS

CN 1118174 A 6/1999
(Continued)

OTHER PUBLICATIONS

Machine-English translation of Japanese patent 10-195601, Ueda Masaharu et al., Jul. 28, 1998.*

(Continued)

*Primary Examiner* — Deborah Yee
(74) *Attorney, Agent, or Firm* — DLA Piper LLP (US)

(57) ABSTRACT

An internal high hardness type pearlitic rail that has a composition containing 0.73% to 0.85% by mass C, 0.5% to 0.75% by mass Si, 0.3% to 1.0% by mass Mn, 0.035% by mass or less P, 0.0005% to 0.012% by mass S, 0.2% to 1.3% by mass Cr, and the balance being Fe and incidental impurities, in which the value of [% Mn]/[% Cr] is greater than or equal to 0.3 and less than 1.0, where [% Mn] represents the Mn content, and [% Cr] represents the Cr content, and in which the internal hardness of a rail head that is defined by the Vickers hardness of a portion located from a surface layer of the rail head to a depth of at least 25 mm is greater than or equal to 380 Hv and less than 480 Hv.

18 Claims, 2 Drawing Sheets

U.S. PATENT DOCUMENTS 5,658,400 A 8/1997 Uchino et al.

FOREIGN PATENT DOCUMENTS

| | | | | |
|---|---|---|---|---|
| JP | 50-047808 | A | | 4/1975 |
| JP | 55-002768 | A | | 1/1980 |
| JP | 8-109439 | A | | 4/1996 |
| JP | 8-144016 | A | | 6/1996 |
| JP | 8/246100 | A | | 9/1996 |
| JP | 8-246101 | A | | 9/1996 |
| JP | 9-241747 | A | | 9/1997 |
| JP | 10-195601 | | * | 7/1998 |
| JP | 10-195601 | A | | 7/1998 |
| JP | 2002-069585 | A | | 3/2002 |
| JP | 2003-293086 | A | | 10/2003 |

OTHER PUBLICATIONS

"Residual Elements" , Metallurgy of Stainless Steels, p. 14-2, ASM 1992.*

English-hand translation of Japanese patent 10-195601, Ueda Masaharu et al. Jul. 28, 1998.*

* cited by examiner

INTERNAL HIGH HARDNESS TYPE PEARLITIC RAIL WITH EXCELLENT WEAR RESISTANCE AND ROLLING CONTACT FATIGUE RESISTANCE AND METHOD FOR PRODUCING SAME

RELATED APPLICATIONS

This is a §371 of International Application No. PCT/JP2008/056277, with an international filing date of Mar. 25, 2008 (WO 2008/123483 A1, published Oct. 16, 2008), which is based on Japanese Patent Application Nos. 2007-084400, filed Mar. 28, 2007, and 2007-264824, filed Oct. 10, 2007.

TECHNICAL FIELD

This disclosure relates to an internal high hardness type pearlitic rail with excellent wear resistance and rolling contact fatigue (RCF) resistance and a method for producing the same. Specifically, the disclosure relates to an internal high hardness type pearlitic rail having excellent wear resistance and rolling contact fatigue resistance and achieving longer operating life of rails used under severe high-axle load conditions like foreign mining railways in which freight cars are heavy and high curve lines are often present, and to a method for producing the internal high hardness type pearlitic rail.

BACKGROUND

In high-axle load railways mainly transporting mineral ores, a load on an axle of a freight car is significantly higher than that of a passenger car, and the use environment of rails is also severe. Rails used in such an environment have been mainly composed of steel having a pearlitic structure from the viewpoint of significant concern of wear resistance. To enhance the efficiency of railway transport, progress has recently been made in increasing carrying capacity. Thus, there is a need for further improvement in wear resistance and rolling contact fatigue resistance. High-axle load railways are used to indicate railways in which trains and freight cars have a large carrying capacity (for example, a carrying capacity of about 150 ton or more per freight car).

In recent years, various studies have been conducted to further improve wear resistance. For example, in Japanese Unexamined Patent Application Publication Nos. 8-109439 and 8-144016, the C content is increased to more than 0.85% and 1.20% by mass or less. In Japanese Unexamined Patent Application Publication Nos. 8-246100 and 8-246101, the C content is increased to more than 0.85% to 1.20% by mass or less and a rail head is subjected to heat treatment. In this way, for example, a technique for improving wear resistance by increasing the C content to increase the cementite ratio has been used.

Meanwhile, rails placed in curved sections of high-axle load railways are subjected to rolling stress due to wheels and slip force due to centrifugal force, causing severe wear of rails and fatigue damage due to slippage. As described above, in the case where the C content is simply more than 0.85% and 1.20% by mass or less, a proeutectoid cementite structure is formed depending on heat treatment conditions, and the amount of a cementite layer in a brittle lamellar pearlitic structure is also increased; hence, rolling contact fatigue resistance is not improved. Japanese Unexamined Patent Application Publication No. 2002-69585, thus, discloses a technique for inhibiting the formation of proeutectoid cementite by addition of Al and Si to improve rolling contact fatigue resistance. The addition of Al, however, causes the formation of an oxide acting as a starting point of fatigue damage, for example. It is thus difficult to satisfy both wear resistance and rolling contact fatigue resistance of a steel rail having a pearlitic structure.

To improve the operating life of rails, in Japanese Unexamined Patent Application Publication No. 10-195601, a portion located from the surface of corners and of the top of the head of the rail to a depth of at least 20 mm have a hardness of 370 HV or more, thereby improving the operating life of the rail. In Japanese Unexamined Patent Application Publication No. 2003-293086, by controlling a pearlite block, a portion located from the surface of corners and of the top of the head of the rail to a depth of at least 20 mm have a hardness of 300 HV to 500 HV, thereby improving the operating life of the rail.

The use environment of pearlitic rails, however, has been increasingly severe. To improve the operating life of pearlitic rails, there have been a challenge for higher hardness and the expansion of the range of hardening depth.

SUMMARY

We changed the amounts of Si, Mn, and Cr and changed the quench hardenability index (hereinafter, referred to as "DI") and carbon equivalent (hereinafter, referred to as "$C_{eq}$") and increased the hardness of a portion located from the surface of a rail head to a depth of at least 25 mm, as compared with hypoeutectoid-, eutectoid-, and hypereutectoid-type pearlitic rails in the related art, thereby providing an internal high hardness type pearlitic rail with excellent wear resistance and rolling contact fatigue resistance.

We produced pearlitic rails with different proportions of Si, Mn, and Cr and conducted intensive studies on the structure, hardness, wear resistance, and rolling contact fatigue resistance. As a result, we found that in the case where the [% Mn]/[% Cr] value, which is calculated from the Mn content [% Mn] and the Cr content [% Cr], is greater than or equal to 0.3 and less than 1.0, the spacing of the lamella (lamellar spacing) of a pearlite layer (hereinafter, also referred to simply as a "lamella") is reduced, and the internal hardness of a rail head that is defined by the Vickers hardness of a portion located from a surface layer of the rail head to a depth of at least 25 mm is greater than or equal to 380 Hv and less than 480 Hv, thereby improving wear resistance and rolling contact fatigue resistance. Furthermore, we found that in the case where the quench hardenability index (i.e., the DI value) is in the range of 5.6 to 8.6, the carbon equivalent (i.e., the $C_{eq}$ value) is in the range of 1.04 to 1.27, and the value of [% Si]+[% Mn]+[% Cr], which is calculated from the Mn content [% Mn], the Cr content [% Cr], and the Si content [% Si], is in the range of 1.55% to 2.50% by mass, the effect of improving wear resistance and rolling contact fatigue resistance can be stably maintained.

We thus provide an internal high hardness type pearlitic rail with excellent wear resistance and rolling contact fatigue resistance has a composition containing 0.73% to 0.85% by mass C, 0.5% to 0.75% by mass Si, 0.3% to 1.0% by mass Mn, 0.035% by mass or less P, 0.0005% to 0.012% by mass S, 0.2% to 1.3% by mass Cr, and the balance being Fe and incidental impurities, in which the value of [% Mn]/[% Cr] is greater than or equal to 0.3 and less than 1.0, where [% Mn] represents the Mn content, and [% Cr] represents the Cr content, and in which the internal hardness of a rail head is defined by the Vickers hardness of a portion located from a surface layer of the rail head to a depth of at least 25 mm and is greater than or equal to 380 Hv and less than 480 Hv.

In the internal high hardness type pearlitic rail, preferably, the value of DI calculated from expression (1) is in the range of 5.6 to 8.6 and the value of $C_{eq}$ calculated from expression (2) is in the range of 1.04 to 1.27, $$DI=(0.548[\%\ C]^{1/2})\times(1+0.64[\%\ Si])\times(1+4.1[\%\ Mn])\times(1+2.83[\%\ P])\times(1-0.62[\%\ S])\times(1+2.23[\%\ Cr]) \quad (1);$$

and $$C_{eq}=[\%\ C]+([\%\ Si]/11)+([\%\ Mn]/7)+([\%\ Cr]/5.8) \quad (2)$$

where [% C] represents the C content, [% Si] represents the Si content, [% Mn] represents the Mn content, [% P] represents the P content, [% S] represents the S content, and [% Cr] represents the Cr content of the composition.

Preferably, the value of [% Si]+[% Mn]+[% Cr] is in the range of 1.55% to 2.50% by mass, where [% Si] represents the Si content, [% Mn] represents the Mn content, and [% Cr] represents the Cr content of the composition. Preferably, the composition further contains one or two or more selected from 0.001% to 0.30% by mass V, 1.0% by mass or less Cu, 1.0% by mass or less Ni, 0.001% to 0.05% by mass Nb, and 0.5% by mass or less Mo.

In the internal high hardness type pearlitic rail, preferably, the lamellar spacing of a pearlite layer in the portion located from the surface layer of the rail head to a depth of at least 25 mm is in the range of 0.04 to 0.15 μm.

Furthermore, a method for producing an internal high hardness type pearlitic rail with excellent wear resistance and rolling contact fatigue resistance includes hot-rolling a steel material having the composition described above to form a rail in such a manner that the finishing rolling temperature is in the range of 850° C. to 950° C., and then slack-quenching the head of the rail from a temperature equal to or higher than a pearlite transformation starting temperature to 400° C. to 650° C. at a cooling rate of 1.2 to 5° C./s.

A pearlitic rail having excellent wear resistance and rolling contact fatigue resistance can be stably produced compared with pearlitic rails in the related art. This contributes to longer operating life of pearlitic rails used for high-axle load railways and to the prevention of railway accidents, providing industrially beneficial effects.

BRIEF DESCRIPTION OF DRAWINGS

FIG. 1A is a plan view, and FIG. 1B is a side view.

FIG. 3A is a plan view, and FIG. 3B is a side view.

REFERENCE NUMERALS

Figure 1A:
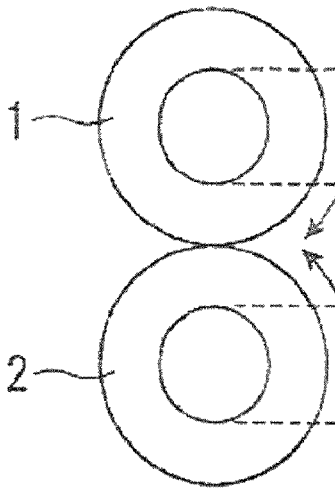
FIGS. 1A and 1B show a Nishihara-type rolling contact test piece used for evaluation of wear resistance.

1 Nishihara-type rolling contact test piece taken from pearlitic rail

1*a* Nishihara-type rolling contact test piece taken from surface layer of rail head

1*b* Nishihara-type rolling contact test piece taken from inside of rail head

2 tire specimen

3 rail head

DETAILED DESCRIPTION

The reason for selections for the conditions of an internal high hardness type pearlitic rail including the composition will be described.

C: 0.73% to 0.85% by mass

C is an essential element to form cementite in a pearlitic structure to ensure wear resistance. The wear resistance is improved as the C content is increased. At a C content of less than 0.73% by mass, however, it is difficult to provide high wear resistance compared with heat treatment-type pearlitic rails in the conventional art. A C content exceeding 0.85% by mass results in the formation of proeutectoid cementite in austenite grain boundaries during transformation after hot rolling, thereby significantly reducing rolling contact fatigue resistance. Thus, the C content is set in the range of 0.73% to 0.85% by mass and preferably 0.75% to 0.85% by mass.

Si: 0.5% to 0.75% by mass

Si is an element serving as a deoxidizer and strengthening a pearlitic structure and needed in an amount of 0.5% by mass or more. A Si content exceeding 0.75% by mass results in a deterioration in weldability due to high bond strength of Si with oxygen. Further more, high hardenability of Si facilitates the formation of a martensitic structure in a surface layer of the internal high hardness type pearlitic rail. Thus, the Si content is set in the range of 0.5% to 0.75% by mass and preferably 0.5% to 0.70% by mass.

Mn: 0.3% to 1.0% by mass

Mn reduces a pearlite transformation starting temperature to reduce a lamellar spacing. Thus, Mn contributes to higher strength and higher ductility of the internal high hardness type pearlitic rail. An excessive amount of Mn added reduces the equilibrium transformation temperature of pearlite to reduce the degree of supercooling, increasing the lamellar spacing. A Mn content of less than 0.3% by mass does not result in a sufficient effect. A Mn content exceeding 1.0% by mass facilitates the formation of a martensitic structure, so that hardening and embrittlement occur during heat treatment and welding, thereby readily reducing the quality of the material. Furthermore, even if the pearlitic structure is formed, the equilibrium transformation temperature is reduced, thereby increasing the lamellar spacing. Thus, the Mn content is set in the range of 0.3% to 1.0% by mass and preferably 0.3% to 0.8% by mass.

P: 0.035% by mass or less

A P content exceeding 0.035% results in a deterioration in ductility. Thus, the P content is set to 0.035% by mass or less and preferably 0.020% by mass or less.

S: 0.0005% to 0.012% by mass

S is present in steel mainly in the form of A-type inclusions. A S content exceeding 0.012% by mass results in a significant increase in the amount of the inclusions and results in the formation of coarse inclusions, thereby reducing cleanliness of steel. A S content of less than 0.0005% by mass leads to an increase in steelmaking cost. Thus, the S content is set in the range of 0.0005% to 0.012% by mass, preferably 0.0005% to 0.010% by mass, and more preferably 0.0005% to 0.008% by mass.

Cr: 0.2% to 1.3% by mass

Cr is an element that increases the equilibrium transformation temperature of pearlite to contribute to a reduction in lamellar spacing and that further increases the strength by solid-solution strengthening. However, a Cr content of less than 0.2% by mass does not result in sufficient internal hardness. A Cr content exceeding 1.3% by mass results in excessively high quench hardenability, forming martensite to reduce wear resistance and rolling contact fatigue resistance. Thus, the Cr content is set in the range of 0.2% to 1.3% by mass, preferably 0.3% to 1.3% by mass, and more preferably 0.5% to 1.3% by mass.

[% Mn]/[% Cr]: greater than or equal to 0.3 and less than 1.0

Mn and Cr are additive elements to increase the hardness of the internal high hardness type pearlitic rail. In the case where an appropriate balance between the Mn content [% Mn] and the Cr content [% Cr] is not achieved, however, martensite is formed in a surface layer of the internal high hardness type pearlitic rail. Note that the units of [% Mn] and [% Cr] are percent by mass. When the value of [% Mn]/[% Cr] is less than 0.3, the Cr content is high. This facilitates the formation of martensite in the surface layer of the internal high hardness type pearlitic rail due to high hardenability of Cr. When the value of [% Mn]/[% Cr] is 1.0 or more, the Mn content is high. This also facilitates the formation of martensite in the surface layer of the internal high hardness type pearlitic rail due to high hardenability of Mn. In the case where the Mn content and the Cr content are set in the above ranges respectively and where the value of [% Mn]I[% Cr] is greater than or equal to 0.3 and less than 1.0, the internal hardness of the head of the rail (hardness of a portion located from the surface layer of the head of the internal high hardness type pearlitic rail to a depth of at least 25 mm) can be controlled within a range described below while the formation of martensite in the surface layer is being prevented. Thus, the value of [% Mn]/[% Cr] is greater than or equal to 0.3 and less than 1.0 and preferably in the range of 0.3 to 0.9.

DI: 5.6 to 8.6

The value of DI is calculated from expression (1) described below:

$$DI=(0.548[\%\ C]^{1/2})\times(1+0.64[\%\ Si])\times(1+4.1[\%\ Mn])\times(1+2.83[\%\ P])\times(1-0.62[\%\ S])\times(1+2.23[\%\ Cr]) \quad (1)$$

where [% C] represents the C content, [% Si] represents the Si content, [% Mn] represents the Mn content, [% P] represents the P content, [% S] represents the S content, and [% Cr] represents the Cr content. Note that the units of [% C], [% Si], [% Mn], [% P], [% S], and [% Cr] are percent by mass.

The DI value indicates quench hardenability and is used as an index to determine whether hardenability is good or not. The DI value is used as an index to prevent the formation of martensite in the surface layer of the internal high hardness type pearlitic rail and to achieve a target value of the internal hardness of the rail head. The DI value is preferably maintained within a suitable range. At a DI value of less than 5.6, although a desired internal hardness is provided, the internal hardness is close to the lower limit of the target hardness range. Thus, it is unlikely that the wear resistance and rolling contact fatigue resistance will be further improved. A DI value exceeding 8.6 results in an increase in the hardenability of the internal high hardness type pearlitic rail, facilitating the formation of martensite in the surface layer of the rail head. Thus, the DI value is preferably in the range of 5.6 to 8.6 and more preferably 5.6 to 8.2.

$C_{eq}$: 1.04 to 1.27

The value of $C_{eq}$ is calculated from expression (2) described below:

$$C_{eq}=[\%\ C]+([\%\ Si]/11)+([\%\ Mn]/7)+([\%\ Cr]/5.8) \quad (2)$$

where [% C] represents the C content, [% Si] represents the Si content, [% Mn] represents the Mn content, and [% Cr] represents the Cr content. Note that the units of [% C], [% Si], [% Mn], and [% Cr] are percent by mass.

The $C_{eq}$ value is used to estimate the maximum hardness and weldability from proportions of the alloy components added. The $C_{eq}$ value is used as an index to prevent the formation of martensite in the surface layer of the internal high hardness type pearlitic rail and to achieve a target value of the internal hardness of the rail head. The $C_{eq}$ value is preferably maintained within a suitable range. At a $C_{eq}$ value of less than 1.04, although a desired internal hardness is provided, the internal hardness is close to the lower limit of the target hardness range. Thus, it is unlikely that the wear resistance and rolling contact fatigue resistance will be further improved. A $C_{eq}$ value exceeding 1.27 results in an increase in the hardenability of the internal high hardness type pearlitic rail, facilitating the formation of martensite in the surface layer of the rail head. Thus, the $C_{eq}$ value is preferably in the range of 1.04 to 1.27 and more preferably 1.04 to 1.20.

Internal hardness of rail head (hardness of portion located from surface layer of head of internal high hardness type pearlitic rail to depth of at least 25 mm): greater than or equal to 380 Hv and less than 480 Hv An internal hardness of the rail head of less than 380 Hv results in a reduction in the wear resistance of steel, thereby reducing the operating life of the internal high hardness type pearlitic rail. An internal hardness of the rail head of 480 Hv or more results in the formation of martensite, thereby reducing the rolling contact fatigue resistance of steel. Thus, the internal hardness of the rail head is greater than or equal to 380 Hv and less than 480 Hv. The reason the internal hardness of the rail head is defined by the hardness of the portion located from the surface layer of the head of the internal high hardness type pearlitic rail to a depth of at least 25 mm is as follows: at a depth of less than 25 mm, the wear resistance of the internal high hardness type pearlitic rail is reduced with increasing distance from the surface layer of the rail head toward the inside, reducing the operating life. Preferably, the internal hardness of the rail head is greater than 390 Hv and less than 4801 Hv.

[% Si]+[% Mn]+[% Cr]: 1.55% to 2.50% by mass

When the sum of the Si content [% Si], the Mn content [% Mn], and the Cr content [% Cr] (=[% Si]+[% Mn]+[% Cr]) is less than 1.55% by mass, it is difficult to satisfy an internal hardness of the rail head greater than or equal to 380 Hv and less than 480 Hv. When the sum exceeds 2.50% by mass, a martensitic structure is formed because of high hardenability of Si, Mn, and Cr. This is liable to cause a reduction in ductility and toughness. Thus, the value of [% Si]+[% Mn]+[% Cr] is preferably in the range of 1.55% to 2.50% by mass and more preferably 1.55% to 2.30% by mass. The units of [% Si], [% Mn], and [% Cr] are percent by mass.

The composition described above may further contain one or two or more selected from 0.001% to 0.30% by mass V, 1.0% by mass or less Cu, 1.0% by mass or less Ni, 0.001% to 0.05% by mass Nb, and 0.5% by mass or less Mo, as needed.

V: 0.001% to 0.30% by mass

V forms a carbonitride that is dispersively precipitated in a matrix, improving wear resistance. At a V content of less than 0.001% by mass, the effect is reduced. A V content exceeding 0.30% by mass results in a reduction in workability, thereby increasing production cost. Furthermore, an increase in alloy cost increases the cost of the internal high hardness type pearlitic rail. Thus, in the case where V is added, the V content is preferably in the range of 0.001% to 0.30% by mass and more preferably 0.001% to 0.15% by mass.

Cu: 1.0% by mass or less

Like Cr, Cu is an element that further increases the strength by solid-solution hardening. To provide the effect, the Cu content is preferably 0.005% by mass or more. A Cu content exceeding 1.0% by mass, however, is liable to cause Cu cracking. Thus, in the case where Cu is added, the Cu content is preferably 1.0% by mass or less and more preferably 0.005% to 0.5% by mass.

Ni: 1.0% by mass or less

Ni is an element that increases the strength without reducing ductility. Furthermore, the addition of Ni together with Cu suppresses Cu cracking. Thus, when Cu is added, preferably, Ni is also added. To provide the effects, the Ni content is preferably 0.005% or more. The Ni content exceeding 1.0% by mass, however, results in an increase in hardenability, forming martensite. This is liable to cause a reduction in wear resistance and rolling contact fatigue resistance. In the case where Ni is added, thus, the Ni content is preferably 1.0% by mass or less and more preferably 0.005% to 0.5% by mass.

Nb: 0.001% to 0.05% by mass

Nb is combined with C in steel to precipitate as a carbide during and after rolling and contributes to a reduction in pearlite colony size. This leads to significant improvement in wear resistance, rolling contact fatigue resistance and ductility and significant contribution to longer operating life of the internal high hardness type pearlitic rail. To provide the effects, a Nb content of 0.001% by mass or more is preferred. At a Nb content exceeding 0.05% by mass, the effect of improving wear resistance and rolling contact fatigue resistance is saturated, the effect is not worth the amount added. In the case where Nb is added, thus, the Nb content is preferably in the range of 0.001% to 0.05% by mass and more preferably 0.001% to 0.03% by mass.

Mo: 0.5% by mass or less

Mo is an element that increases the strength by solid-solution hardening. To provide the effect, the Mn content is preferably 0.005% by mass or more. A Mo content exceeding 0.5% by mass is liable to cause the formation of a bainitic structure and to reduce wear resistance. In the case where Mo is added, thus, the Mo content is preferably 0.5% by mass or less and more preferably 0.005% to 0.3% by mass.

Lamellar spacing of pearlite layer in portion located from surface layer of rail head to depth of at least 25 mm: 0.04 to 0.15 μm A reduction in the lamellar spacing of a pearlite layer increases the hardness of the internal high hardness type pearlitic rail, which is advantageous from the viewpoint of improving wear resistance and rolling contact fatigue resistance. A lamellar spacing exceeding 0.15 μm does no result in sufficient improvement in these properties. Thus, the lamellar spacing is preferably 0.15 μm or less. On the other hand, for reducing the lamellar spacing to less than 0.04 μm, a technique for reducing the lamellar spacing by improving quench hardenability is to be used. This is liable to cause the formation of martensite in the surface layer, thereby adversely affecting rolling contact fatigue resistance. Thus, the lamellar spacing is preferably 0.04 (μm or more.

We also include a pearlitic rail containing other trace elements in place of part of the balance Fe in a composition to the extent that the effect is not substantially affected. Here, examples of impurities include P, N, and 0. A P content of up to 0.035% by mass is allowable as described above. An N content of up to 0.006% by mass is allowable. An 0 content of up to 0.004% by mass is allowable. Furthermore, a Ti content of up to 0.0010% is allowable, Ti being contained as an impurity. In particular, Ti forms an oxide to reduce rolling contact fatigue resistance, which is a basic property of the rail. Thus, the Ti content is preferably controlled so as to be 0.0010% or less.

The internal high hardness type pearlitic rail is preferably produced by hot-rolling a steel material with a composition to form a rail shape in such a manner that the finishing rolling temperature is in the range of 850° C. to 950° C., and slack-quenching at least the head of the rail article from a temperature equal to or higher than a pearlite transformation starting temperature to 400° C. to 650° C. at a cooling rate of 1.2 to 5° C./s. The reason for a finishing rolling temperature (roll finishing temperature) of 850° C. to 950° C., a cooling rate of the slack quenching of 1.2 to 5° C./s, and a cooling stop temperature of 400° C. to 650° C. is described below.

Finishing rolling temperature: 850° C. to 950° C.

In the case of a finishing rolling temperature of less than 850° C., rolling is performed to a low-temperature austenite range. This not only introduces processing strain in austenite grains but also causes a significantly high degree of extension of austenite grains. The introduction of dislocation and an increase in austenite grain boundary area result in an increase in the number of pearlite nucleation sites. Although the pearlite colony size is reduced, the increase in the number of pearlite nucleation sites increases a pearlite transformation starting temperature, thereby increasing the lamellar spacing of the pearlite layer to cause a significant reduction in wear resistance. Meanwhile, a finishing rolling temperature exceeding 950° C. increases the austenite grain size, thereby increasing the final pearlite colony size to cause a reduction in rolling contact fatigue resistance. Thus, the finishing rolling temperature is preferably in the range of 850° C. to 950° C.

Cooling rate from temperature equal to or higher than pearlite transformation starting temperature: 1.2 to 5° C./s A cooling rate of less than 1.2° C./s results in an increase in pearlite transformation starting temperature, thereby increasing the lamellar spacing of the pearlite layer to cause a significant reduction in wear resistance and rolling contact fatigue resistance. Meanwhile, a cooling rate exceeding 5° C./s results in the formation of a martensitic structure, thereby reducing ductility and toughness. Thus, the cooling rate is preferably in the range of 1.2 to 5° C./s and more preferably 1.2 to 4.6° C./s. Although the pearlite transformation starting temperature varies depending on the cooling rate, the pearlite transformation starting temperature is referred to as an equilibrium transformation temperature. In the composition range of our rails, the cooling rate within the above range may be used at 720° C. or higher.

Cooling stop temperature: 400° C. to 650° C.

In the case of the composition and the cooling rate, to obtain a uniform pearlitic structure at a cooling rate of 1.2 to 5° C./s, it is preferable to ensure a cooling stop temperature of at least about 70° C. lower than the equilibrium transformation temperature. A cooling stop temperature of less than 400° C., however, results in an increase in cooling time, leading to an increase in the cost of the internal high hardness type pearlitic rail. Thus, the cooling stop temperature is preferably in the range of 400° C. to 650° C. and more preferably 450° C. to 650° C.

Next, methods for measuring and evaluating wear resistance, rolling contact fatigue resistance, the internal hardness of the rail head, and the lamellar spacing will be described.

(Wear Resistance)

Figure 1B:
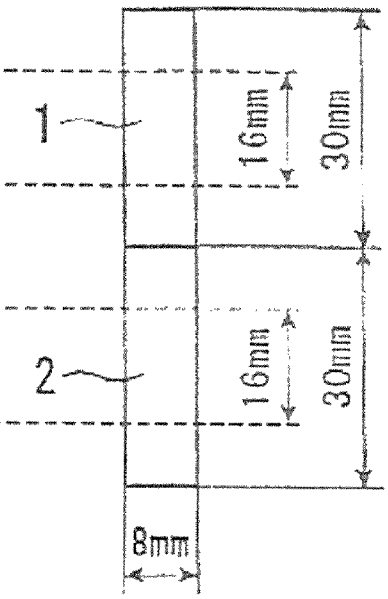
Figure 2:
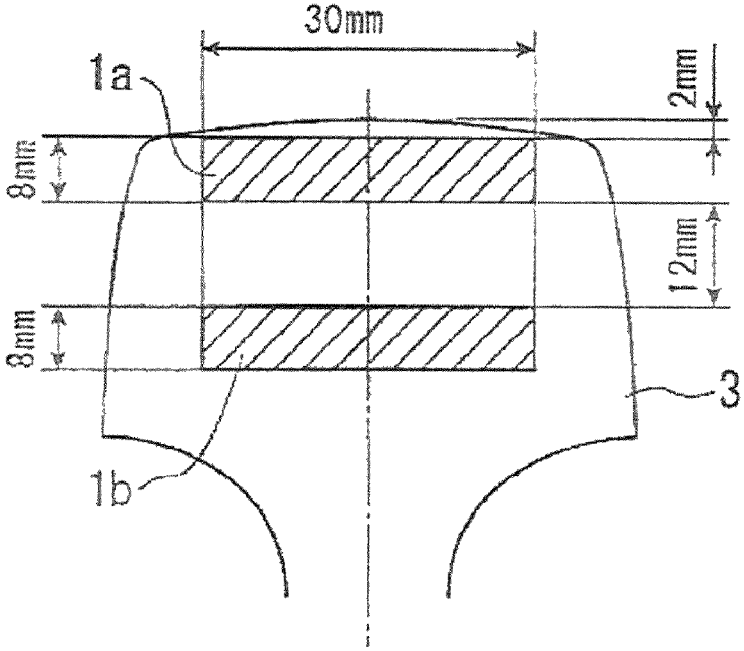
FIG. 2 is a cross-sectional view of a rail head and illustrates positions where Nishihara-type rolling contact test pieces are taken.

With respect to wear resistance, most preferably, the internal high hardness type pearlitic rail is actually placed and evaluated. In this case, disadvantageously, it takes a long time to conduct a test. Thus, evaluation is made by a comparative test performed under simulated real conditions of rail and wheel contact with a Nishihara-type rolling contact test machine that can evaluate wear resistance in a short time. A Nishihara-type rolling contact test piece 1 having an external diameter of 30 mm is taken from the rail head. The test is performed by contacting the test piece 1 with a tire specimen 2 and rotating them as shown in FIG. 1. Arrows in FIG. 1 indicate rotational directions of the Nishihara-type rolling contact test piece 1 and the tire specimen 2. With respect to the tire specimen, a round bar with a diameter of 32 mm is taken from the head of a standard rail (Japanese industrial standard rail) described in JIS E1101. The round bar is subjected to heat treatment so as to have a Vickers hardness of 390 HV (load: 98 N) and a tempered martensitic structure. Then the round bar is processed so as to have a shape shown in FIG. 1, resulting in the tire specimen. Note that the Nishihara-type rolling contact test piece 1 is taken from each of two portions of a rail head 3 as shown in FIG. 2. A piece taken from a surface layer of the rail head 3 is referred to as a Nishihara-type rolling contact test piece 1*a*. A piece taken from the inside is referred to as a Nishihara-type rolling contact test piece 1*b*. The center of the Nishihara-type rolling contact test piece 1*b*, which is taken from the inside of the rail head 3, in the longitudinal direction is located at a depth of 24 to 26 mm (mean value: 25 mm) below the top face of the rail head 3. The test is performed in a dry state at a contact pressure of 1.4 GPa, a slip ratio of −10%, and a rotation speed of 675 rpm (750 rpm for the tire specimen). The wear amount at 100,000 rotations is measured. A heat-treated pearlitic rail is employed as reference steel used in comparing wear amounts. It is determined that the wear resistance is improved when the wear amount is at least 10% smaller than that of the reference steel. Note that the rate of improvement in wear resistance is calculated from {(wear amount of reference steel−wear amount of test piece)/(wear amount of reference steel)}×100.

(Rolling Contact Fatigue Resistance)

Figure 3A:
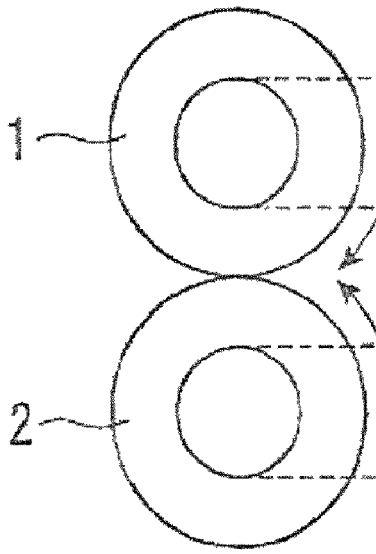
FIGS. 3A and 3B show a Nishihara-type rolling contact test piece used for evaluation of rolling contact fatigue resistance.
Figure 3B:
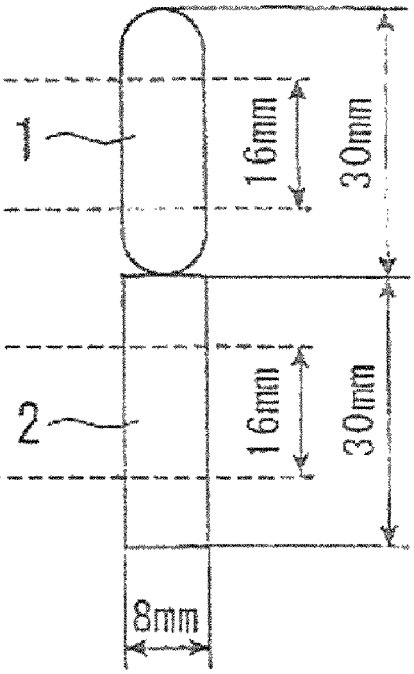

With respect to rolling contact fatigue resistance, the Nishihara-type rolling contact test piece 1 having an external diameter of 30 mm and a curved contact surface with a radius of curvature of 15 mm is taken from the rail head. A test is performed by contacting the test piece 1 with the tire specimen 2 and rotating them as shown in FIG. 3. Arrows in FIG. 3 indicate rotational directions of the Nishihara-type rolling contact test piece 1 and the tire specimen 2. Note that the Nishihara-type rolling contact test piece 1 is taken from each of two portions of a rail head 3 as shown in FIG. 2. The tire specimen and each portion where the Nishihara-type rolling contact test piece 1 is taken are the same as above; hence, the description is omitted. The test is performed under an oil-lubricated condition at a contact pressure of 2.2 GPa, a slip ratio of −20%, and a rotation speed of 600 rpm (750 rpm for the tire specimen). The surface of each test piece is observed every 25,000 rotations. The number of rotations at the occurrence of a crack with a length of 0.5 mm or more is defined as rolling contact fatigue life. A heat-treated pearlitic rail is employed as reference steel used in comparing rolling contact fatigue life. It is determined that the rolling contact fatigue resistance is improved when the rolling contact fatigue life is at least 10% longer than that of the reference steel. Note that the rate of improvement in rolling contact fatigue resistance is calculated from {(number of rotations at occurrence of fatigue damage of test piece−number of rotation at occurrence of fatigue damage of reference steel)/(number of rotations at occurrence of fatigue damage of reference steel)}×100.

(Internal Hardness of Rail Head)

The Vickers hardness of a portion located from the surface layer of the rail head of to a depth of 25 mm is measured at a load of 98 N and a pitch of 1 mm. Among all hardness values, the minimum hardness value is defined as the internal hardness of the rail head.

(Lamellar Spacing)

Random five fields of view of each of a portion (at a depth of about 1 mm) close to the surface layer of the rail head and a portion located at a depth of 25 mm are observed with a scanning electron microscope (SEM) at a magnification of 7,500×. In the case where a portion with the minimum lamellar spacing is present, the portion is observed at a magnification of 20,000×, and the lamellar spacing in the field of view is measured. In the case where no small lamellar spacing is observed in a field of view at a magnification of 7,500× or where the section of a lamellar structure is not perpendicular to a lamellar surface but is obliquely arranged, the measurement is performed in another field of view. The lamellar spacing is evaluated by the mean value of the lamellar spacing measurements in the five fields of view.

EXAMPLES

Example 1

Steel materials with compositions shown in Table 1 were subjected to rolling and cooling under conditions shown in Table 2 to produce pearlitic rails. Cooling was performed only at heads of the rails. After termination of the cooling, the pearlitic rails were subject to natural cooling. The resulting pearlitic rails were evaluated for Vickers hardness, lamellar spacing, wear resistance, and rolling contact fatigue resistance. Table 3 shows the results. The finishing rolling temperature shown in Table 2 indicates a value obtained by measuring a temperature of the surface layer of a side face of each rail head on the entrance side of a final roll mill with a radiation thermometer. The cooling stop temperature indicates a value obtained by measuring a temperature of the surface layer of a side face of each rail head on the exit side of a cooling apparatus with a radiation thermometer. The cooling rate was defined as the rate of change in temperature between the start and end of cooling.

The results demonstrated the following: In the case where the [% Mn]/[% Cr] value was greater than or equal to 0.3 and less than 1.0, the portion located from the surface layer of the rail head to a depth of at least 25 mm had a hardness greater than or equal to 380 Hv and less than 480 Hv, so that the wear resistance and the rolling contact fatigue resistance were improved. In each of 1-L to 1-Q, i.e., in the case where the [% Mn]/[% Cr] value was outside the range in which the [% Mn]/[% Cr] value was greater than or equal to 0.3 and less than 1.0, the inside of the rail head (that is, a portion located at a depth of 25 mm below the surface layer) did not have a hardness greater than or equal to 380 Hv and less than 480 Hv, so that the wear resistance and the rolling contact fatigue resistance were reduced. Alternatively, martensite was formed in the vicinity of the surface layer of the rail head, thereby reducing the rolling contact fatigue resistance. Among these examples, in each of 1-B to 1-G and 1-S to 1-U, i.e., in the case of a DI value of 5.6 to 8.6 and a $C_{eq}$ of 1.04 to 1.27, the wear resistance and the rolling contact fatigue resistance were improved compared with 1-H to 1-K. Among these examples, in 1-R, i.e., in the case where the value of [% Si]+[% Mn]+[% Cr] was not controlled so as to be in the range of 1.55 to 2.50% by mass, although the portion located at a depth of 25 mm below the surface layer of the rail head had a hardness greater than or equal to 380 Hv and less than 480 Hv, the properties of pearlitic rail were reduced compared with the case in which the value of [% Si]+[% Mn]+[% Cr] was controlled so as to be 1.55 to 2.50% by mass.

Example 2

Steel materials with compositions shown in Table 4 were subjected to rolling and cooling under conditions shown in Table 5 to produce pearlitic rails. Cooling was performed only at heads of the rails. After termination of the cooling, the pearlitic rails were allowed to cool. Like Example 1, the resulting pearlitic rails were evaluated for Vickers hardness, lamellar spacing, wear resistance, and rolling contact fatigue resistance. Table 6 shows the results.

The results demonstrated the following: In each of 2-B to 2-J and 2-T to 2-V, i.e., in the case where the amounts of Si, Mn, and Cr added were optimized, the [% Mn]/[% Cr] value was greater than or equal to 0.3 and less than 1.0, the value of [% Si]+[% Mn]+[% Cr] was controlled so as to be in the range of 1.55 to 2.50% by mass, and one or two or more components selected from V, Cu, Ni, and Mo were added in proper amounts, the wear resistance and the rolling contact fatigue resistance were improved. Among these examples, in each of 2-B, 2-C, 2-E, 2-F, 2-J, and 2-T to 2-V, i.e., in the case where of a DI value of 5.6 to 8.6 and a $C_{eq}$ of 1.04 to 1.27, the wear resistance and the rolling contact fatigue resistance were improved compared with 2-D and 2-G to 2-I. Among these examples, in each of 2-D and 2-I, i.e., in the case where the value of [% Si]+[% Mn]+[% Cr] was not controlled so as to be in the range of 1.55 to 2.50% by mass, although the portion located at a depth of 25 mm below the surface layer of the rail head had a hardness greater than or equal to 380 Hv and less than 480 Hv, the properties of pearlitic rail were reduced compared with the case in which the value of [% Si]+[% Mn]+[% Cr] was controlled so as to be 1.55 to 2.50% by mass. In 2-S, i.e., in the case of adding Ti, the rolling contact fatigue resistance was reduced.

INDUSTRIAL APPLICABILITY

A pearlitic rail having excellent wear resistance and rolling contact fatigue resistance compared with pearlitic rails in the related art can be stably produced. This contributes to longer operating life of pearlitic rails used for high-axle load railways and to the prevention of railway accidents, providing industrially beneficial effects.

TABLE 2

| Steel No. | Roll finishing temperature (° C.) | Cooling stop temperature (° C.) | Cooling rate (° C./s) | Remarks |
|---|---|---|---|---|
| 1-A | 900 | 500 | 2.0 | Reference material |
| 1-B | 950 | 550 | 1.8 | Example |
| 1-C | 900 | 500 | 4.6 | |
| 1-D | 850 | 550 | 2.1 | |
| 1-E | 950 | 500 | 1.9 | |
| 1-F | 900 | 550 | 1.9 | |
| 1-G | 950 | 500 | 2.0 | |
| 1-H | 900 | 500 | 4.6 | |
| 1-I | 850 | 550 | 2.1 | |
| 1-J | 900 | 500 | 1.3 | |
| 1-K | 900 | 600 | 3.0 | |
| 1-L | 850 | 550 | 1.5 | Comparative example |
| 1-M | 900 | 450 | 2.1 | |
| 1-N | 900 | 500 | 1.6 | |
| 1-P | 950 | 550 | 2.5 | |
| 1-Q | 850 | 550 | 2.5 | |
| 1-R | 850 | 500 | 1.5 | Example |
| 1-S | 950 | 550 | 2.5 | Example |
| 1-T | 850 | 550 | 2.5 | |
| 1-U | 850 | 500 | 1.5 | |

TABLE 1

(mass % excluding mass ratio, DI, and Ceq)

| Steel No. | C | Si | Mn | P | S | Cr | [% Mn]/[% Cr] | DI | Ceq | [% Si] + [% Mn] + [% Cr] | Remarks |
|---|---|---|---|---|---|---|---|---|---|---|---|
| 1-A | 0.68 | 0.18 | 1.00 | 0.014 | 0.016 | 0.20 | 5.0 | 3.8 | 0.87 | 1.38 | Reference material |
| 1-B | 0.84 | 0.52 | 0.35 | 0.012 | 0.012 | 1.21 | 0.3 | 6.2 | 1.15 | 2.08 | Example |
| 1-C | 0.83 | 0.53 | 0.63 | 0.013 | 0.011 | 0.67 | 0.9 | 6.2 | 1.08 | 1.83 | |
| 1-D | 0.79 | 0.54 | 0.48 | 0.016 | 0.005 | 0.88 | 0.5 | 6.0 | 1.06 | 1.90 | |
| 1-E | 0.80 | 0.51 | 0.59 | 0.012 | 0.007 | 0.81 | 0.7 | 6.4 | 1.07 | 1.91 | |
| 1-F | 0.83 | 0.68 | 0.62 | 0.011 | 0.003 | 0.67 | 0.9 | 6.5 | 1.10 | 1.97 | |
| 1-G | 0.85 | 0.74 | 0.49 | 0.020 | 0.008 | 0.61 | 0.8 | 5.6 | 1.09 | 1.84 | |
| 1-H | 0.83 | 0.74 | 0.41 | 0.012 | 0.004 | 0.46 | 0.9 | 4.1 | 1.04 | 1.61 | |
| 1-I | 0.77 | 0.51 | 0.41 | 0.012 | 0.008 | 0.77 | 0.5 | 4.8 | 1.01 | 1.69 | |
| 1-J | 0.76 | 0.74 | 0.31 | 0.014 | 0.009 | 0.71 | 0.4 | 4.3 | 0.99 | 1.76 | |
| 1-K | 0.79 | 0.69 | 0.42 | 0.013 | 0.007 | 0.45 | 0.9 | 4.0 | 0.99 | 1.56 | |
| 1-L | 0.75 | 0.51 | 0.95 | 0.019 | 0.005 | 0.25 | 3.8 | 5.0 | 0.98 | 1.71 | Comparative |
| 1-M | 0.83 | 0.53 | 0.55 | 0.011 | 0.009 | 0.51 | 1.1 | 4.8 | 1.04 | 1.59 | example |
| 1-N | 0.81 | 0.51 | 0.77 | 0.013 | 0.015 | 0.15 | 5.1 | 3.7 | 0.99 | 1.43 | |
| 1-P | 0.77 | 0.55 | 0.75 | 0.014 | 0.003 | 0.71 | 1.1 | 7.1 | 1.05 | 2.01 | |
| 1-Q | 0.81 | 0.51 | 0.31 | 0.014 | 0.005 | 1.29 | 0.2 | 6.0 | 1.12 | 2.11 | |
| 1-R | 0.80 | 0.51 | 0.45 | 0.015 | 0.002 | 0.52 | 0.9 | 4.2 | 1.00 | 1.48 | Example |
| 1-S | 0.83 | 0.69 | 0.39 | 0.014 | 0.003 | 0.92 | 0.4 | 5.9 | 1.11 | 2.00 | Example |
| 1-T | 0.78 | 0.70 | 0.53 | 0.013 | 0.003 | 0.81 | 0.7 | 6.5 | 1.06 | 2.04 | |
| 1-U | 0.82 | 0.51 | 0.51 | 0.014 | 0.004 | 0.81 | 0.6 | 5.9 | 1.08 | 1.83 | |

TABLE 3

| | Surface layer of rail | | | | | | | Inside of rail 25 mm | |
|---|---|---|---|---|---|---|---|---|---|
| Steel No. | Hardness of rail (HV) | Lamellar spacing (μm) | Structure | Wear amount (g) | Rate of improvement in wear resistance (%) | Number of rotations at occurrence of rolling contact fatigue ($\times 10^5$ rotations) | Rate of Improvement in rolling ontact fatigue resistance (%) | Hardness of rail (HV) | Lamellar spacing (μm) |
| 1-A | 370 | 0.16 | P | 1.30 | — | 8.10 | — | 340 | 0.23 |
| 1-B | 470 | 0.05 | P | 1.05 | 19.2 | 10.13 | 25.1 | 435 | 0.07 |
| 1-C | 415 | 0.10 | P | 1.13 | 13.1 | 9.45 | 16.7 | 390 | 0.12 |
| 1-D | 430 | 0.08 | P | 1.10 | 15.4 | 9.90 | 22.2 | 415 | 0.09 |
| 1-E | 420 | 0.05 | P | 1.11 | 14.6 | 9.68 | 19.5 | 399 | 0.10 |
| 1-F | 432 | 0.06 | P | 1.09 | 16.2 | 9.90 | 22.2 | 408 | 0.09 |
| 1-G | 427 | 0.07 | P | 1.10 | 15.4 | 9.90 | 22.2 | 402 | 0.10 |
| 1-H | 400 | 0.10 | P | 1.17 | 10.0 | 9.00 | 11.1 | 382 | 0.14 |
| 1-I | 410 | 0.08 | P | 1.16 | 10.8 | 9.23 | 14.0 | 383 | 0.14 |
| 1-J | 408 | 0.09 | P | 1.16 | 10.8 | 9.23 | 14.0 | 380 | 0.15 |
| 1-K | 401 | 0.10 | P | 1.17 | 10.0 | 9.00 | 11.1 | 381 | 0.15 |
| 1-L | 410 | 0.08 | P | 1.14 | 12.3 | 9.45 | 16.7 | 375 | 0.17 |
| 1-M | 395 | 0.12 | P | 1.16 | 10.8 | 9.00 | 11.1 | 355 | 0.19 |
| 1-N | 395 | 0.12 | P | 1.17 | 10.0 | 9.00 | 11.1 | 350 | 0.21 |
| 1-P | 410 | 0.09 | P | 1.14 | 12.3 | 9.45 | 16.7 | 375 | 0.16 |
| 1-Q | 492 | — | P + M | 1.15 | 11.5 | 7.88 | −2.7 | 429 | 0.06 |
| 1-R | 400 | 0.11 | P | 1.15 | 11.5 | 9.23 | 14.0 | 380 | 0.15 |
| 1-S | 431 | 0.07 | P | 1.09 | 16.2 | 9.90 | 22.2 | 402 | 0.09 |
| 1-T | 420 | 0.08 | P | 1.10 | 15.4 | 9.68 | 19.5 | 400 | 0.10 |
| 1-U | 432 | 0.07 | P | 1.09 | 16.2 | 9.90 | 22.2 | 403 | 0.09 |

| | Inside of rail 25 mm | | | | | |
|---|---|---|---|---|---|---|
| Steel No. | Structure | Wear amount (g) | Rate of improvement in wear resistance (%) | Number of rotations at occurrence of rolling contact fatigue ($\times 10^5$ rotations) | Rate of improvement in rolling contact fatigue resistance (%) | Remarks |
| 1-A | P | 1.40 | — | 7.65 | — | Reference material |
| 1-B | P | 1.11 | 20.7 | 9.90 | 29.4 | Example |
| 1-C | P | 1.18 | 15.7 | 9.00 | 17.6 | |
| 1-D | P | 1.15 | 17.9 | 9.23 | 20.7 | |
| 1-E | P | 1.17 | 16.4 | 9.00 | 17.6 | |
| 1-F | P | 1.16 | 17.1 | 9.23 | 20.7 | |
| 1-G | P | 1.17 | 16.4 | 9.00 | 17.6 | |
| 1-H | P | 1.26 | 10.0 | 8.55 | 11.8 | |
| 1-I | P | 1.26 | 10.0 | 8.55 | 11.8 | |
| 1-J | P | 1.25 | 10.7 | 8.55 | 11.8 | |
| 1-K | P | 1.26 | 10.0 | 8.55 | 11.8 | |
| 1-L | P | 1.30 | 7.1 | 8.33 | 8.9 | Comparative |
| 1-M | P | 1.35 | 3.6 | 8.10 | 5.9 | example |
| 1-N | P | 1.37 | 2.1 | 8.10 | 5.9 | |
| 1-P | P | 1.29 | 7.9 | 8.33 | 8.9 | |
| 1-Q | P | 1.12 | 20.0 | 9.23 | 20.7 | |
| 1-R | P | 1.26 | 10.0 | 8.55 | 11.8 | Example |
| 1-S | P | 1.15 | 17.9 | 9.23 | 20.7 | Example |
| 1-T | P | 1.17 | 16.4 | 9.00 | 17.6 | |
| 1-U | P | 1.16 | 17.1 | 9.23 | 20.7 | |

P represents pearlite,

θ represents proeutectoid cementite, and

M represents martensite.

TABLE 4

| Steel No. | C | Si | Mn | P | S | Cr | V | Nb | Gu | Ni | Mo | Ti | [% Mn]/[% Cr] | DI | Ceq | [% Si] + [% Mn] + [% Cr] | Remarks |
|---|---|---|---|---|---|---|---|---|---|---|---|---|---|---|---|---|---|
| | | | | | | | | | | | | | | (mass % excluding mass ratio, DI, and Ceq) | | | |
| 2-A | 0.68 | 0.18 | 1.00 | 0.014 | 0.016 | 0.20 | | | | | | | 5.0 | 3.8 | 0.87 | 1.38 | Reference material |
| 2-B | 0.84 | 0.75 | 0.32 | 0.014 | 0.008 | 1.20 | 0.05 | | | | 0.05 | | 0.3 | 6.5 | 1.16 | 2.27 | Example |
| 2-C | 0.75 | 0.71 | 0.58 | 0.012 | 0.004 | 0.81 | 0.22 | | | | | | 0.7 | 6.7 | 1.04 | 2.10 | |
| 2-D | 0.81 | 0.61 | 0.32 | 0.013 | 0.008 | 0.43 | | 0.02 | | | | | 0.7 | 3.2 | 0.99 | 1.36 | |
| 2-E | 0.83 | 0.55 | 0.77 | 0.013 | 0.006 | 0.85 | | 0.04 | 0.05 | 0.05 | | | 0.9 | 8.4 | 1.14 | 2.17 | |
| 2-F | 0.82 | 0.73 | 0.47 | 0.014 | 0.006 | 1.28 | 0.02 | 0.01 | | | | | 0.4 | 8.5 | 1.17 | 2.48 | |
| 2-G | 0.81 | 0.51 | 0.45 | 0.014 | 0.005 | 0.61 | | | 0.11 | 0.13 | 0.11 | | 0.7 | 4.6 | 1.03 | 1.57 | |
| 2-H | 0.83 | 0.66 | 0.46 | 0.013 | 0.007 | 0.72 | 0.12 | 0.03 | 0.15 | 0.22 | | | 0.6 | 5.5 | 1.08 | 1.84 | |
| 2-I | 0.85 | 0.51 | 0.39 | 0.012 | 0.006 | 0.63 | | 0.02 | | | 0.05 | | 0.6 | 4.3 | 1.06 | 1.53 | |
| 2-J | 0.76 | 0.51 | 0.83 | 0.009 | 0.007 | 0.91 | 0.05 | | | | | | 0.9 | 8.6 | 1.08 | 2.25 | |
| 2-K | 0.70 | 0.63 | 0.66 | 0.013 | 0.004 | 0.83 | 0.03 | 0.01 | | | | | 0.8 | 7.0 | 0.99 | 2.12 | ComparAtive |
| 2-L | 1.01 | 0.72 | 0.59 | 0.012 | 0.003 | 0.66 | | | | | 0.05 | | 0.9 | 7.0 | 1.27 | 1.97 | example |
| 2-M | 0.85 | 0.95 | 1.01 | 0.013 | 0.007 | 0.87 | | | 0.05 | 0.05 | | | 1.2 | 12.7 | 1.23 | 2.83 | |
| 2-N | 0.82 | 0.63 | 0.31 | 0.014 | 0.003 | 1.25 | | 0.03 | | | 0.12 | | 0.2 | 6.2 | 1.14 | 2.19 | |
| 2-P | 0.81 | 0.51 | 1.15 | 0.012 | 0.008 | 0.91 | 0.01 | | | | | | 1.3 | 11.7 | 1.18 | 2.57 | |
| 2-Q | 0.82 | 0.63 | 1.21 | 0.013 | 0.008 | 0.15 | 0.03 | 0.05 | | | | | 8.1 | 5.7 | 1.08 | 1.99 | |
| 2-R | 0.79 | 0.73 | 0.83 | 0.013 | 0.007 | 1.35 | | | 0.05 | 0.05 | | | 0.6 | 13.0 | 1.21 | 2.91 | |
| 2-S | 0.78 | 0.75 | 0.46 | 0.014 | 0.008 | 0.85 | | 0.01 | | | | 0.01 | 0.5 | 6.2 | 1.06 | 2.06 | |
| 2-T | 0.84 | 0.58 | 0.57 | 0.014 | 0.003 | 0.79 | 0.06 | | | | | | 0.7 | 6.6 | 1.11 | 1.94 | Example |
| 2-U | 0.83 | 0.59 | 0.53 | 0.012 | 0.004 | 0.69 | 0.05 | | | | | | 0.8 | 5.7 | 1.08 | 1.81 | |
| 2-V | 0.82 | 0.59 | 0.54 | 0.015 | 0.002 | 0.65 | 0.03 | | | | | | 0.8 | 5.6 | 1.06 | 1.78 | |

TABLE 5

| Steel No. | Roll finishing temperature (° C.) | Cooling stop temperature (° C.) | Cooling rate (° C./s) | Remarks |
|---|---|---|---|---|
| 2-A | 900 | 500 | 2.0 | Reference material |
| 2-B | 950 | 600 | 1.3 | Example |
| 2-C | 950 | 450 | 4.5 | |
| 2-D | 900 | 500 | 4.9 | |
| 2-E | 900 | 500 | 2.2 | |
| 2-F | 950 | 550 | 2.5 | |
| 2-G | 900 | 650 | 1.8 | |
| 2-H | 850 | 600 | 4.8 | |
| 2-I | 900 | 500 | 2.2 | |
| 2-J | 900 | 500 | 1.7 | |
| 2-K | 950 | 500 | 2.2 | Comparative example |

TABLE 5-continued

| Steel No. | Roll finishing temperature (° C.) | Cooling stop temperature (° C.) | Cooling rate (° C./s) | Remarks |
|---|---|---|---|---|
| 2-L | 950 | 500 | 1.9 | |
| 2-M | 950 | 550 | 3.5 | |
| 2-N | 900 | 500 | 4.3 | |
| 2-P | 900 | 600 | 3.3 | |
| 2-Q | 900 | 600 | 2.1 | |
| 2-R | 850 | 550 | 3.3 | |
| 2-S | 900 | 550 | 3.1 | |
| 2-T | 900 | 550 | 2.7 | Example |
| 2-U | 900 | 550 | 2.6 | |
| 2-V | 850 | 450 | 3.1 | |

TABLE 6

| | Surface layer of rail | | | | | | | Inside of rail 25 mm | |
|---|---|---|---|---|---|---|---|---|---|
| Steel No. | Hardness of rail (HV) | Lamellar spacing (μm) | Structure | Wear amount (g) | Rate of improvement in wear resistance (%) | Number of rotations at occurrence of rolling contact fatigue ($\times 10^5$ rotations) | Rate of improvement in rolling contact fatigue resistance (%) | Hardness of rail (HV) | Lamellar spacing (μm) |
| 2-A | 370 | 0.16 | P | 1.37 | — | 8.10 | — | 340 | 0.23 |
| 2-B | 451 | 0.07 | P | 1.08 | 21.2 | 10.35 | 27.8 | 433 | 0.07 |
| 2-C | 455 | 0.07 | P | 1.07 | 21.9 | 10.13 | 25.1 | 436 | 0.07 |
| 2-D | 415 | 0.10 | P | 1.14 | 16.8 | 9.68 | 19.5 | 381 | 0.14 |
| 2-E | 433 | 0.08 | P | 1.12 | 18.2 | 9.68 | 19.5 | 405 | 0.10 |
| 2-F | 462 | 0.05 | P | 1.03 | 24.8 | 10.58 | 30.6 | 432 | 0.08 |
| 2-G | 423 | 0.08 | P | 1.14 | 16.8 | 9.68 | 19.5 | 382 | 0.12 |
| 2-H | 423 | 0.09 | P | 1.13 | 17.5 | 9.45 | 16.7 | 387 | 0.11 |
| 2-I | 410 | 0.10 | P | 1.14 | 16.8 | 9.45 | 16.7 | 380 | 0.15 |
| 2-J | 431 | 0.12 | P | 1.11 | 19.0 | 9.68 | 19.5 | 401 | 0.10 |
| 2-K | 399 | 0.12 | P | 1.17 | 14.6 | 9.00 | 11.1 | 362 | 0.18 |
| 2-L | 441 | 0.08 | P + θ | 1.12 | 18.2 | 9.68 | 19.5 | 378 | 0.16 |
| 2-M | 512 | — | P + M | 1.21 | 11.7 | 8.10 | 0.0 | 409 | 0.10 |
| 2-N | 498 | — | P + M | 1.22 | 10.9 | 7.88 | −2.7 | 421 | 0.08 |
| 2-P | 510 | — | P + M | 1.21 | 11.7 | 8.33 | 2.8 | 419 | 0.08 |
| 2-Q | 415 | 0.09 | P | 1.15 | 16.1 | 9.45 | 16.7 | 373 | 0.17 |

TABLE 6-continued

| | | | | | | | | | |
|---|---|---|---|---|---|---|---|---|---|
| 2-R | 562 | — | P + M | 1.18 | 13.9 | 7.88 | −2.7 | 441 | 0.07 |
| 2-S | 428 | 0.07 | P | 1.12 | 18.2 | 7.43 | −8.3 | 381 | 0.15 |
| 2-T | 439 | 0.07 | P | 1.09 | 20.4 | 9.90 | 22.2 | 401 | 0.09 |
| 2-U | 428 | 0.07 | P | 1.10 | 19.7 | 9.68 | 19.5 | 396 | 0.10 |
| 2-V | 425 | 0.08 | P | 1.12 | 18.2 | 9.68 | 19.5 | 392 | 0.11 |

| | Inside of rail 25 mm | | | | | |
|---|---|---|---|---|---|---|
| Steel No. | Structure | Wear amount (g) | Rate of improvement in wear resistance (%) | Number of rotations at occurrence of rolling contact fatigue ($\times 10^5$ rotations) | Rate of improvement in rolling contact fatigue resistance (%) | Remarks |
| 2-A | P | 1.40 | — | 7.65 | — | Reference material |
| 2-B | P | 1.12 | 20.0 | 9.45 | 23.5 | Example |
| 2-C | P | 1.13 | 19.3 | 9.45 | 23.5 | |
| 2-D | P | 1.18 | 15.7 | 8.78 | 14.8 | |
| 2-E | P | 1.18 | 15.7 | 9.23 | 20.7 | |
| 2-F | P | 1.11 | 20.7 | 9.45 | 23.5 | |
| 2-G | P | 1.16 | 17.1 | 8.78 | 14.8 | |
| 2-H | P | 1.19 | 15.0 | 8.78 | 14.8 | |
| 2-I | P | 1.16 | 17.1 | 8.78 | 14.8 | |
| 2-J | P | 1.18 | 15.7 | 9.23 | 20.7 | |
| 2-K | P | 1.34 | 4.3 | 8.10 | 5.9 | Comparative |
| 2-L | P | 1.31 | 6.4 | 8.33 | 8.9 | example |
| 2-M | P | 1.20 | 14.3 | 8.78 | 14.8 | |
| 2-N | P | 1.15 | 17.9 | 9.00 | 17.6 | |
| 2-P | P | 1.17 | 16.4 | 9.23 | 20.7 | |
| 2-Q | P | 1.33 | 5.0 | 8.33 | 8.9 | |
| 2-R | P | 1.11 | 20.7 | 9.45 | 23.5 | |
| 2-S | P | 1.19 | 15.0 | 7.20 | −5.9 | |
| 2-T | P | 1.14 | 18.6 | 9.45 | 23.5 | Example |
| 2-U | P | 1.15 | 17.9 | 9.23 | 20.7 | |
| 2-V | P | 1.16 | 17.1 | 9.00 | 17.6 | |

P represents pearlite,
θ represents proeutectoid cementite, and
M represents martensite.

The invention claimed is:

1. An internal high hardness pearlitic rail comprising a composition containing 0.73% to 0.85% by mass C, 0.5% to 0.75% by mass Si, 0.3% to 1.0% by mass Mn, 0.035% by mass or less P, 0.0005% to 0.012% by mass S, 0.2% to 1.3% by mass Cr, and the balance being Fe and incidental impurities, wherein the value of [% Mn]/[% Cr] is greater than or equal to 0.3 and less than 1.0, where [% Mn] represents the Mn content, and [% Cr] represents the Cr content, and wherein the internal hardness of a rail head is defined by a Vickers hardness of a portion located from a surface layer of the rail head to a depth of at least 25 mm and is greater than or equal to 380 Hv and less than 480 Hv.

2. The internal high hardness pearlitic rail according to claim 1, wherein the value of DI calculated from expression (1) is in the range of 5.6 to 8.6, and the value of $C_{eq}$ calculated from expression (2) is in the range of 1.04 to 1.27, $$DI=(0.548[\%\ C]^{1/2})\times(1+0.64[\%\ Si])\times(1+4.1[\%\ Mn])\times(1+2.83[\%\ P])\times(1-0.62[\%\ S])\times(1+2.23[\%\ Cr]) \quad (1);$$

and $$C_{eq}=[\%\ C]+([\%\ Si]/11)+([\%\ Mn]/7)+([\%\ Cr]/5.8) \quad (2)$$

where [% C] represents the C content, [% Si] represents the Si content, [% Mn] represents the Mn content, [% P] represents the P content, [% S] represents the S content, and [% Cr] represents the Cr content of the composition.

3. The internal high hardness pearlitic rail according to claim 1, wherein the value of [% Si]+[% Mn]+[% Cr] is in the range of 1.55% to 2.50% by mass, where [% Si] represents the Si content, [% Mn] represents the Mn content, and [% Cr] represents the Cr content of the composition.

4. The internal high hardness pearlitic rail according to claim 1, wherein the composition further comprises one or two or more selected from 0.001% to 0.30% by mass V, 1.0% by mass or less Cu, 1.0% by mass or less Ni, 0.001% to 0.05% by mass Nb, and 0.5% by mass or less Mo.

5. The internal high hardness pearlitic rail according to claim 1, wherein the lamellar spacing of a pearlite layer in the portion located from the surface layer of the rail head to a depth of at least 25 mm is in the range of 0.04 to 0.15 μm.

6. A method for producing an internal high hardness pearlitic rail comprising:

hot-rolling a steel material having the composition according to claim 1 to form a rail in such a manner that a finishing rolling temperature is in the range of 850° C. to 950° C., and slack-quenching a surface of a rail head from a temperature equal to or higher than a pearlite transformation starting temperature to 400° C. to 650° C. at a cooling rate of 1.2 to 5° C./s so that the internal hardness of a rail head, defined by the Vickers hardness of a portion located from a surface layer of the rail head to a depth of at least 25 mm, is greater than or equal to 380 Hv and less than 480 Hv.

7. The internal high hardness pearlitic rail according to claim 2, wherein the value of [% Si]+[% Mn]+[% Cr] is in the range of 1.55% to 2.50% by mass, where [% Si] represents the Si content, [% Mn] represents the Mn content, and [% Cr] represents the Cr content of the composition.

8. The internal high hardness pearlitic rail according to claim 2, wherein the composition further comprises one or two or more selected from 0.001% to 0.30% by mass V, 1.0% by mass or less Cu, 1.0% by mass or less Ni, 0.001% to 0.05% by mass Nb, and 0.5% by mass or less Mo.

9. The internal high hardness pearlitic rail according to claim 3, wherein the composition further comprises one or two or more selected from 0.001% to 0.30% by mass V, 1.0% by mass or less Cu, 1.0% by mass or less Ni, 0.001% to 0.05% by mass Nb, and 0.5% by mass or less Mo.

10. The internal high hardness pearlitic rail according to claim 7, wherein the composition further comprises one or two or more selected from 0.001% to 0.30% by mass V, 1.0% by mass or less Cu, 1.0% by mass or less Ni, 0.001% to 0.05% by mass Nb, and 0.5% by mass or less Mo.

11. The internal high hardness pearlitic rail according to claim 2, wherein the lamellar spacing of a pearlite layer in the portion located from the surface layer of the rail head to a depth of at least 25 mm is in the range of 0.04 to 0.15 μm.

12. The internal high hardness pearlitic rail according to claim 3, wherein the lamellar spacing of a pearlite layer in the portion located from the surface layer of the rail head to a depth of at least 25 mm is in the range of 0.04 to 0.15 μm.

13. The internal high hardness pearlitic rail according to claim 4, wherein the lamellar spacing of a pearlite layer in the portion located from the surface layer of the rail head to a depth of at least 25 mm is in the range of 0.04 to 0.15 μm.

14. The internal high hardness pearlitic rail according to claim 7, wherein the lamellar spacing of a pearlite layer in the portion located from the surface layer of the rail head to a depth of at least 25 mm is in the range of 0.04 to 0.15 μm.

15. The internal high hardness pearlitic rail according to claim 8, wherein the lamellar spacing of a pearlite layer in the portion located from the surface layer of the rail head to a depth of at least 25 mm is in the range of 0.04 to 0.15 μm.

16. The internal high hardness pearlitic rail according to claim 9, wherein the lamellar spacing of a pearlite layer in the portion located from the surface layer of the rail head to a depth of at least 25 mm is in the range of 0.04 to 0.15 μm.

17. The internal high hardness pearlitic rail according to claim 10, wherein the lamellar spacing of a pearlite layer in the portion located from the surface layer of the rail head to a depth of at least 25 mm is in the range of 0.04 to 0.15 μm.

18. The internal high hardness pearlitic rail according to claim 1, wherein the Vickers hardness is 390 Hv to less than 480 Hv.

* * * * *

UNITED STATES PATENT AND TRADEMARK OFFICE

CERTIFICATE OF CORRECTION

PATENT NO. : 7,955,445 B2
APPLICATION NO. : 12/593463
DATED : June 7, 2011
INVENTOR(S) : Honjo et al.

It is certified that error appears in the above-identified patent and that said Letters Patent is hereby corrected as shown below:

IN THE SPECIFICATIONS:
In Column 15

At Table 4, at column 10, at the subheading, please change “Gu” to --Cu--.

Signed and Sealed this
Twenty-ninth Day of November, 2011

David J. Kappos

David J. Kappos
*Director of the United States Patent and Trademark Office*